United States Patent [19]

Ichikawa et al.

[11] 4,309,890

[45] Jan. 12, 1982

[54] METHOD OF FORMING A CYLINDRICAL MEMBER

[75] Inventors: Shigeo Ichikawa; Satoru Nomichi; Masaki Sinoda, all of Toyota, Japan

[73] Assignee: Taiho Kogyo Co., Ltd., Toyota, Japan

[21] Appl. No.: 84,033

[22] Filed: Oct. 11, 1979

[30] Foreign Application Priority Data

Oct. 16, 1978 [JP] Japan ..... 53-127016

[51] Int. Cl.[3] ..... B21C 37/06; B21D 53/10

[52] U.S. Cl. ..... 72/368; 29/149.5 DP

[58] Field of Search ..... 72/368, 398; 29/149.5 C, 149.5 DP, 400 D; 228/150, 151

[56] References Cited

U.S. PATENT DOCUMENTS

| | | | |
|---|---|---|---|
| 652,658 | 6/1900 | Bischoff | 72/368 |
| 1,330,782 | 2/1920 | Brown | 72/368 |
| 1,964,584 | 6/1934 | Klocke | 29/149.5 C X |
| 2,031,982 | 2/1936 | Salzman | 29/149.5 DP |
| 3,166,827 | 1/1965 | Bushi | 29/149.5 DP |
| 3,521,343 | 7/1970 | Green | 29/149.5 DP |

FOREIGN PATENT DOCUMENTS

| | | | |
|---|---|---|---|
| 743103 | 1/1956 | United Kingdom | 72/368 |

*Primary Examiner*—Nicholas P. Godici

*Attorney, Agent, or Firm*—Blanchard, Flynn, Thiel, Boutell & Tanis

[57] ABSTRACT

A strip material is subjected to an end bending step, and subsequently the bent ends of the strip material, namely, those portions of the strip material which are located adjacent to its abutting ends, are pre-coined to increase the accuracy in the region of the abutting ends, followed by a conventional U-bending and a final coining step, thereby producing a cylindrical material. The use of the pre-coining step for the abutting ends improves the circularity of the cylindrical member.

7 Claims, 3 Drawing Figures

METHOD OF FORMING A CYLINDRICAL MEMBER

BACKGROUND OF THE INVENTION

The invention relates to a method of forming a cylindrical member, in particular, a method of forming a cylindrical member having a highly close dimensional accuracy with a press operation alone without requiring a subsequent processing technique.

A conventional technique to form a cylindrical member such as a bush by a press operation starts with a web material which is cut into strip material of a given length. Only the opposite ends of the strip material are bent into a radius of curvature which is slightly greater than the radius of curvature of a cylindrical member which is intended to be manufactured. Subsequently, the strip is bent into a U-configuration by a bending process, and then placed between a pair of dies which are used in a coining step for forming the U-shaped material into the configuration of cylindrical bearing surfaces which are formed on the pair of dies. The described technique provides a cylindrical member having a favorable configuration when viewed macroscopically. However, when a high level of circularity is required of the products such as bushes, the press operation alone is insufficient to achieve the required accuracy. In particular, the level of circularity of the product in the region of its abutting ends is distinctly degraded in practice as compared with such level of the remaining regions. Consequently, the conventional process of forming a bush required a subsequent processing such as trimming or grinding operation after the bush is formed by a press operation. Hence, it is obvious that there have been a need in the prior art for a technique which improves the machining accuracy and reduces the machining cost.

SUMMARY OF THE INVENTION

It is an object of the invention to provide a method of forming a cylindrical member having a high level of circularity by a press operation alone, without requiring a subsequent processing. The forming method is characterized by the use of a press operation to coin only those portions of a strip material which are adjacent to its abutting ends after both ends of the strip material have been subjected to a bending step.

It is another object of the invention to provide a method of forming a cylindrical member which reduces the machining cost.

Other objects and advantages of the invention will become apparent from the following description taken together with the attached drawings.

DETAILED DESCRIPTION OF EMBODIMENT

Figure 1A:
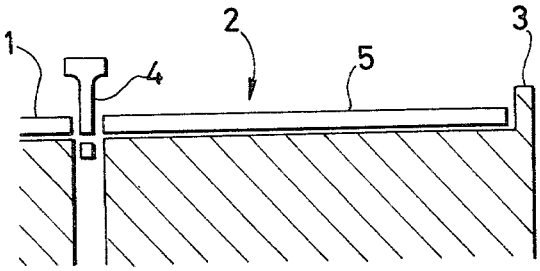
FIGS. 1A to E illustrate sequential steps in the method of forming a cylindrical member in accordance with the invention.
Figure 1B:
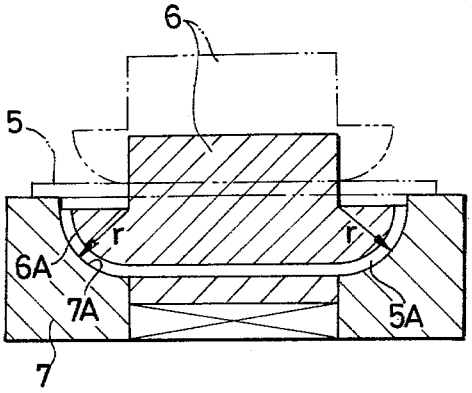
Figure 1C:
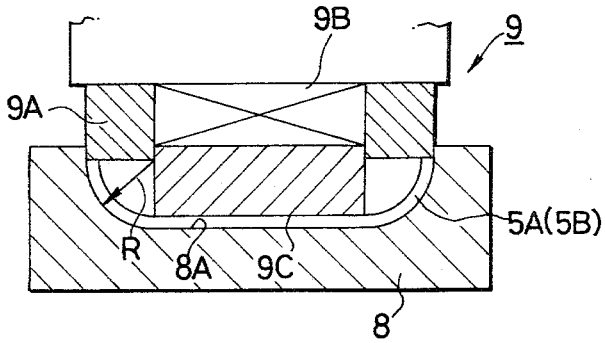
Figure 1D:
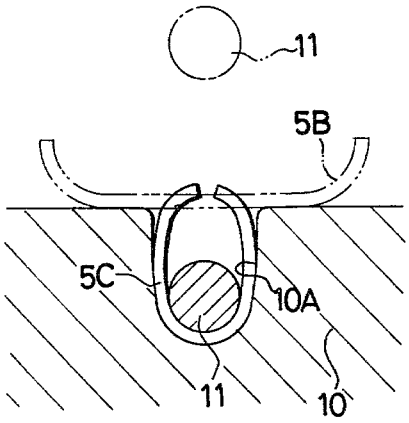
Figure 1E:
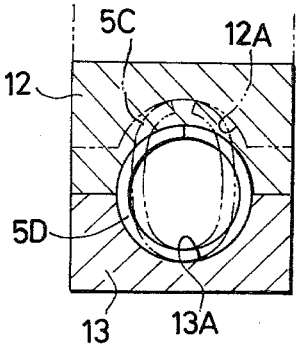

Referring to the drawings, a web material 1 is conveyed into a cutter mechanism by means of a conveyor mechanism, not shown, until its leading end bears against a stop 3, whereupon a cutter 4 is driven downward to cut the web material 1 to a given length. A strip material 5, which is rectangular in configuration and has a given width and length, is taken out of the cutting step A, and fed to a following bending step B where it is placed between an upper die 6 and a lower die 7, which are utilized to bend the opposite ends of the strip material 5. The ends 6A, 7A of the bearing surfaces have a radius of curvature r which is generally slightly greater than the radius of curvature R of the bush which is to be finally produced. In other words, the opposite ends of the strip material 5 obtained by the end bending step B are susceptible to a further bending.

The method of the invention is characterized by the use of an end coining step C subsequent to the end bending step B. The purpose of the step C is to finish only the ends of strip material 5A to a curvature of a high accuracy, the radius of which is substantially equal to or slightly greater than the radius of curvature of the final product. Incidentally, the bearing surface 8A of a lower die 8 which is used in the end coining step C has a radius of curvature which is equal to or slightly greater than the radius of curvature R of the final product. A slightly greater radius of curvature is employed when it is necessary to take into consideration a machining operation which takes place during a final coining step E. An upper die 9 has a pair of abutment areas 9A which bear against and press down the end faces or the faces of the strip material 5A which are to abut against each other, and a flat area 9C which bears against the central region of the strip material 5A and which is driven downward by means of resilient member 9B. As the upper die 9 moves down and the abutment areas 9A bear against the end faces of the strip material 5A, the strip material 5A is coined under such pressure to the curvature (1/R) of the ends of bearing surfaces 8A of the lower die 8. In this manner, the ends of the strip material 5A are coined to a final radius of curvature R which is intended to be obtained in the bush product. The length of the ends of the strip material, which are finished during the end coining step, is determined in consideration of the machining which takes place during the final coining step. As mentioned above, it is not essential that the radius of curvature obtained in this step coincides with the final radius of curvature, but the emphasis is placed on the acquisition of the uniformity of the curvature.

The U-bending step D and the final coining step E which follow the end coining step C are similar to those used in the conventional process. In the U-bending step D, the strip material 5B which has been subjected to the end bending and the finishing step has its central region bent into a radius which is equal to or slightly less than the radius R of the product. Specifically, a lower die 10 has a U-shaped bearing surface 10A, and a rod member 11 is caused to move into the recess defined thereby to form a U-shaped material 5C. The final coining step E employs a pair of upper and lower dies 12, 13 having semi-cylindrical bearing surfaces 12A, 13A. The U-shaped member 5C is placed lengthwise between the upper and lower dies 12, 13 and subsequently both dies are moved toward each other to deform the material 5C under pressure until the U-shaped material 5C is coined to the configuration of the cylindrical bearing surfaces 12A, 13A thereof.

Figure 2:
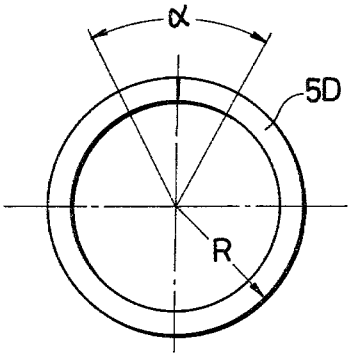
FIG. 2 is a front view of a formed bush.

A bush 5D which is formed by the forming method of the invention which comprises the steps mentioned above has an improved circularity, in particular, in the region of the abutting ends of the original strip material, thereby achieving a high level of circularity for the entire bush. With a conventional forming method which does not include the end coining step C, the end portions of the strip material which are located adjacent to its abutting ends (zone $\alpha$ shown in FIG. 2) may not be sufficiently coined during the final coining step E, and because the initial end bending step alone cannot produce a high accuracy, the circularity in such region is substantially degraded. By contrast, when the bent ends of the strip material 5A are coined previously during the end coining step C in accordance with the invention, the circularity of the entire bush 5D can be substantially improved if the coining operation during the final coining step E is not fully effective over the regions of the material which are located adjacent to its abutting ends.

While the invention has been described above in terms of a bush as a cylindrical member, it should be understood that the invention is equally applicable to form any other cylindrical member, in particular, when a high level of the circularity is required.

While the invention has been described above in terms of a preferred embodiment thereof, it should be understood that the invention is not limited thereto, but that a number of modifications and changes therein will readily occur to those skilled in the art without departing from the scope and spirit of the invention. Therefore, it is intended that the scope of the invention be solely defined by the appended claims.

What is claimed is:

1. A method of forming a cylindrical article having a radius of curvature R, which comprises the steps of:

in a first, bending step, bending upwardly the end portions of a flat, rectangular sheet to form said end portions into arcuate shapes whereby to obtain an intermediate workpiece having a substantially flat central portion and a pair of arcuate, end portions extending upwardly at the ends of said substantially flat central portion, the edges of said arcuate end portions facing upwardly; then coining said arcuate end portions of said intermediate workpiece by placing said intermediate workpiece in a die cavity having a substantially flat bottom wall and a pair of arcuate end walls at the end of said flat bottom wall, said end walls each having a radius of curvature substantially equal to or slightly greater than the radius of curvature R of said cylindrical article, and simultaneously pressing downwardly on the upwardly facing edges of said arcuate end portions to further bend said arcuate end portions of said intermediate workpiece to conform the outer surfaces of said arcuate end portions to the shape of said end walls of said die cavity so that said arcuate end portions of said coined intermediate workpiece have uniform radii of curvature substantially equal to or slightly greater than the radius of curvature of said cylindrical article; then bending the central portion of said coined intermediate workpiece to form same into a U shape in which the edges of said arcuate end portions substantially face each other; and then placing the U-shaped intermediate workpiece between a pair of dies having semi-cylindrical surfaces which mate to define a cylindrical cavity and pressing said U-shaped intermediate workpiece between said dies whereby to form said U-shaped intermediate workpiece into a cylindrical article having a radius of curvature R and wherein said end faces abut against each other.

2. A method according to claim 1, in which the arcuate end walls of said die cavity each have a radius of curvature which is equal to the radius of curvature R of the cylindrical article.

3. A method according to claim 1, in which the arcuate end walls of said die cavity each have a radius of curvature which is slightly greater than the radius of curvature R of the cylindrical article.

4. A method according to claim 1, in which the sheet is obtained by cutting a web material to a given length in a cutting step.

5. A method according to claim 1, in which, during said first, bending step, the end portions of said sheet are each formed to have a radius of curvature which is slightly greater than the radius of curvature of the cylindrical article.

6. A method according to claim 1, in which, during the step of bending said coined intermediate workpiece into U shape, the central portion of said coined intermediate workpiece is bent to have a radius of curvature which is equal to or slightly less than the radius of curvature of the cylindrical article.

7. A method according to claim 1, in which, in said coining step, the flat central portion of said intermediate workpiece is pressed against said flat bottom wall of said die cavity.

* * * * *